US009107794B2

(12) United States Patent
Ewing

(10) Patent No.: US 9,107,794 B2
(45) Date of Patent: Aug. 18, 2015

(54) THERAPEUTIC DEVICE FOR POST-OPERATIVE KNEE

(71) Applicant: Paul Ewing, Franklin, MI (US)

(72) Inventor: Paul Ewing, Franklin, MI (US)

( * ) Notice: Subject to any disclaimer, the term of this patent is extended or adjusted under 35 U.S.C. 154(b) by 271 days.

(21) Appl. No.: 13/679,142

(22) Filed: Nov. 16, 2012

(65) Prior Publication Data

US 2013/0079683 A1 Mar. 28, 2013

Related U.S. Application Data

(63) Continuation-in-part of application No. 12/797,065, filed on Jun. 9, 2010, now Pat. No. 8,333,722, which is a continuation-in-part of application No. 11/585,427, filed on Oct. 24, 2006, now Pat. No. 7,762,963.

(60) Provisional application No. 60/729,698, filed on Oct. 24, 2005.

(51) Int. Cl.

| | |
|---|---|
| ***A61H 1/00*** | (2006.01) |
| ***A61H 1/02*** | (2006.01) |
| ***A61H 5/00*** | (2006.01) |

(52) U.S. Cl.

CPC ..... *A61H 1/024* (2013.01); *A61H 2201/018* (2013.01); *A61H 2201/1215* (2013.01); *A61H 2201/1664* (2013.01); *A61H 2201/1676* (2013.01); *A61H 2201/5007* (2013.01); *A61H 2201/5012* (2013.01); *A61H 2201/5061* (2013.01); *A61H 2201/5069* (2013.01); *A61H 2201/5084* (2013.01); *A61H 2203/0425* (2013.01)

(58) Field of Classification Search

USPC ..... 482/1, 4–9, 900–903, 907; 601/5, 23, 601/33–35

See application file for complete search history.

(56) References Cited

U.S. PATENT DOCUMENTS

| | | | | |
|---|---|---|---|---|
| 4,691,694 | A | 9/1987 | Boyd et al. | |
| 5,078,152 | A * | 1/1992 | Bond et al. | 600/587 |
| 5,209,223 | A * | 5/1993 | McGorry et al. | 601/34 |
| 5,244,441 | A * | 9/1993 | Dempster et al. | 482/9 |
| 5,403,251 | A * | 4/1995 | Belsito et al. | 482/4 |
| 5,454,773 | A | 10/1995 | Blanchard et al. | |
| 6,599,255 | B2 * | 7/2003 | Zhang | 600/587 |
| 2010/0249672 | A1 | 9/2010 | Ewing | |
| 2011/0071002 | A1 | 3/2011 | Gravel et al. | |

FOREIGN PATENT DOCUMENTS

| | | | |
|---|---|---|---|
| WO | WO-9111221 | A1 | 8/1991 |
| WO | WO-02096274 | A2 | 12/2002 |

OTHER PUBLICATIONS

European Search Report from corresponding European Patent Application 13192986.1 issued on Feb. 26, 2014 (6 pages).

* cited by examiner

*Primary Examiner* — Oren Ginsberg

(74) *Attorney, Agent, or Firm* — Harness, Dickey & Pierce, P.L.C.

(57) ABSTRACT

The present teachings provide for an exercise device for exercising a joint and a limb. The device includes a controller, an actuation member, a load cell, and a motor. The actuation member is controlled by the controller and is configured to extend and flex the limb. The load cell is mounted to the actuation member and configured to measure force between the limb and the actuation member. The motor is configured to control movement of the actuation member in response to inputs from the controller.

14 Claims, 9 Drawing Sheets

THERAPEUTIC DEVICE FOR POST-OPERATIVE KNEE

CROSS-REFERENCE TO RELATED APPLICATIONS

This application is a continuation-in-part of U.S. patent application Ser. No. 12/797,065 filed Jun. 9, 2010 (issued as U.S. Pat. No. 8,333,722), which is a continuation-in-part of U.S. patent application Ser. No. 11/585,427 filed Oct. 24, 2006 (issued as U.S. Pat. No. 7,762,963), which claims the benefit of U.S. Patent Application No. 60/729,698 filed on Oct. 24, 2005. The disclosures of these applications are incorporated herein by reference.

FIELD

The present disclosure relates to a therapeutic device for a post-operative knee.

BACKGROUND

This section provides background information related to the present disclosure which is not necessarily prior art.

More than 500,000 patients underwent total knee replacement (TKA) in 2012 in the United States alone, a number that is expected to exceed three million by the year 2025. The rehabilitation process for TKA patients is extensive, costly, and does not always yield optimal results. Many patients struggle to re-gain full mobility following TKA because stiffness in the knee joint can quickly progress to scar tissue in a short time. If this process is not prevented, scar tissue may impede flexibility in the future. Lack of full range of motion not only affects gait and mobility, but can also lead to future back, hip, and joint pain.

The process of inhibited flexibility and accumulation of fluid following TKA progresses through four stages: bleeding, edema, granulation tissue, and fibrosis. Cytokines in the inflammatory cells draw in fibroblasts, which begin to lay down collagen tissue. As the collagen hardens it becomes more and more difficult to eliminate. Scar tissue is basically all collagen and will eventually become fibrosis. This progression typically begins soon after surgery and is well on its way to permanently impeding mobility within 2-4 weeks when outpatient physical therapy typically begins. Lack of range of motion is not normally a focus during the first few weeks of therapy. By the time outpatient physical therapy begins (on average 3-4 weeks post-TKA), it is often not possible to prevent and treat the accumulation of fluid in the periarticular tissue. Failure to achieve a full range of motion in the immediate or early postoperative period, combined with permitting the accumulation of even relatively small amounts of periarticular blood and edema, naturally permits extracellular matrix and collagenous scar tissue to be deposited, such that full range of motion may never be fully recovered. A device and method for removing fluid containing fibroblasts from the periarticular tissue before collagen begins to form would therefore be desirable.

Patients and therapists often resist early rehabilitation because they believe that early manipulation of the joint is exceedingly painful. By limiting the force or pressure used to move a patient's joint to below the patient's comfort threshold, it is possible to decrease or eliminate pain while focusing on terminal extension and flexion.

Patients and physical therapists often delay range of motion therapy after TKA because patients typically experience too much pain if the leg is manipulated toward full range of motion soon after surgery. Existing methods for treating a lack of range of motion include manually pushing and pulling just above and below the knee by a trained physical therapist in an effort to gain better extension and flexion. If the pressure applied is overdone, a risk of doing more damage exists and the inflammatory cycle that started the problem may be repeated. On the other hand, too little pressure results in insufficient progress.

Another issue with existing TKA rehabilitation procedures is that not all patients are the same in terms of their response to therapy. Some patients tend to form scar tissue more rapidly, thicker, and more densely than others. Patients that develop hypertrophic scar and keloids will exhibit loss of function at a faster pace than normal.

Continuous passive motion machines (CPM) are often used in existing TKA therapies. CPM machines depend on flexion and extension values to determine motion. CPM machines push blindly and have no pressure feedback and no pressure variability. CPM machines also cannot stop in mid-cycle, such as to allow for fluid to exit the joint. CPM machines further are not able to provide a high or low amplitude stretch at the extremes of the patient's range of motion, such as by holding the leg in a flexed or extended position. It would therefore be desirable to provide a device and method capable of increasing a patient's range of motion more quickly while minimizing pain.

CPM machines undesirably set limits on extension and flexion and operate only within these limits. If the limits are set too aggressively, the joint can experience excess stress, leading to pain and potentially additional injury. Typically, CPM machines are used to exercise a pre-specified range of motion limited by fixing the target angles within the patient's existing range of motion, which is already achievable by the patient. This becomes self-limiting and can undesirably leave periarticular fluid in the joint, reinforcing existing limits of extension and flexion, and preventing meaningful progress.

SUMMARY

This section provides a general summary of the disclosure, and is not a comprehensive disclosure of its full scope or all of its features.

The present teachings provide for an exercise device for exercising a joint and a limb. The device includes a controller, an actuation member, a load cell, and a motor. The actuation member is controlled by the controller and is configured to move between a first position and a second position. The load cell is mounted to the actuation member and configured to measure force between the limb and the actuation member. The motor is configured to control movement of the actuation member in response to inputs from the controller.

The present teachings also provide for a method for exercising a joint and a limb. The method includes extending the limb with an actuation member of an exercise device; slowing or stopping extension of the limb when a measured extension force between the actuation member and the limb is at least equal to a predetermined target extension force; flexing the limb with the actuation member; and slowing or stopping flexion of the limb when a measured flexion force between the actuation member and the limb is at least equal to a predetermined target flexion force.

The present teachings further provide for a method that includes preventing movement of an exercise device actuation member in a first direction unless force exerted by the limb against the actuation member is equal to or greater than a predetermined first target force. The method further includes preventing movement of the actuation member in a second direction unless force exerted by the limb against the actuation member is equal to or greater than a predetermined second target force.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
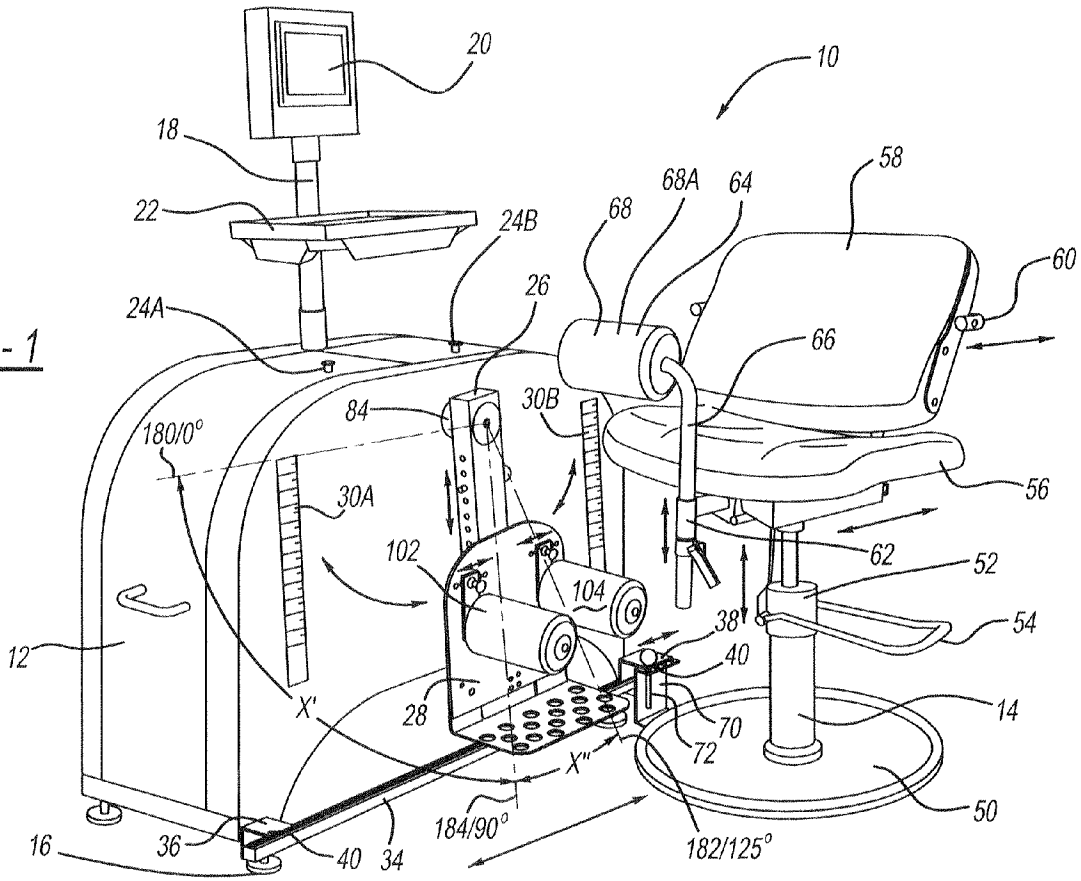
FIG. 1 is a perspective view of an exercise device according to the present teachings.

With initial referenced to FIG. 1, an exercise device according to the present teachings is illustrated at reference numeral 10. The exercise device 10 generally includes a case 12 and a seat 14. The case 12 includes a plurality of supports 16 extending from an undersurface thereof to support the case 12 on a flat surface, such as a floor of a clinic or home. A post 18 extends from an upper surface of the case 12, which is opposite to the undersurface from which the supports 16 extend. A display 20 is mounted to the post 18, as well as a tray 22. The display 20 can be any suitable display for use in operating the device 10. For example, the display 20 can be a touchscreen capable of accepting input commands for operating the device 10, and for displaying the operational status of the device 10 to the user and operator, such as a physical therapist. Also at the upper surface of the case 12 proximate to the post 18 is a first stop button 24A on a first side of the post 18 and a second stop button 24B on a second side of the post 18. The stop buttons 24A and 24B can be used to stop all operation of the exercise device.

The exercise device further includes an actuation member or actuation arm 26, which is rotatably mounted at a side of the case 12. Connected to the actuation arm 26 is a limb coupling member 28. As described herein, the limb coupling member 28 is configured to couple with a user's ankle. The limb coupling member 28 can also be configured to couple with any other body portion to be exercised and actuated, such as a user's arm. Mounted to the case 12 on opposite sides of the actuation arm 26 is a first extension ruler 30A and a second extension rule 30B. The extension rulers 30A and 30B include indicia that allows the degree of extension of a user's limb to be visually measured. The first extension ruler 30A can be used to measure extension when the seat 14 is in the first position illustrated in FIG. 1. The second extension ruler 30B can be used to measure extension when the seat 14 is in a second position in which the seat 14 is moved to an end of the case 12 opposite to the end of the case 12 at which the seat 14 is positioned in FIG. 1.

The exercise device 10 further includes a seat track 34 extending along a length of the case 12. At a first end of the case 12, the seat track 34 is mounted to the case 12 with a first mount 36. At a second end of the case 12, the seat track 34 is mounted to the case 12 with a second mount 38. Each of the first mount 36 and the second mount 38 define a plurality of apertures 40. The apertures 40 are configured to receive a coupling device to lock the seat to either the first mount 36 or the second mount 38. When locked to the second mount 38 at the second end of the case 12 for example, the seat 14 will be positioned to exercise the user's right leg. The seat 14 can be moved along the seat track 34 to the first end and coupled to the first mount 36 to exercise the user's left leg by turning the seat around to allow the left leg to be seated in the limb coupling member 28 of the actuation arm 26.

The seat 14 generally includes a floor support 50, a vertical support 52 extending from the floor support 50, a vertical adjustment lever for adjusting the height of the vertical support 52, a base 56 mounted on top of the vertical support 52, and a back rest 58 mounted over the base 56 with a back rest support 60. The back rest 58 can be moved horizontally relative to the base 56 by sliding the back rest support 60 horizontally with respect to the base 56. The back rest support 60 can include a series of suitable locking features to lock the back rest 58 in a desired position.

The seat 14 further includes a support sleeve 62 for a knee support 64. The sleeve 62 is mounted proximate to the base, particularly in front of the base 56, and is configured to receive a knee support 64. In particular, a vertical portion 66 of the knee support 64 is slidably received within the sleeve 62. A horizontal portion 68 of the knee support 64 is mounted to the vertical portion 66, and is covered with a padded portion 68A. The knee support 64 can be raised and lowered by sliding the vertical portion 66 to a desired position within the sleeve 62. The knee support 64 can be moved to any suitable position or height to support a user's knee at a suitable height, with the knee being positioned below the pad 68A. While the knee can be supported at any suitable position, it is often desirable to support the knee such that it is vertically aligned with a horizontal shaft 84 (FIGS. 1 and 2) to which the actuation arm 26 is coupled. A locator 124 (FIG. 2) can be included with the actuation arm 26 at the horizontal shaft 84 to facilitate alignment of the knee with the horizontal shaft 84. Any suitable locator 124 can be used, such as a laser.

Extending from the floor support 50 of the seat 14 is a coupling flange 70. The coupling flange 70 includes a series of apertures that can be selectively aligned with the apertures 40 of either the first mount 36 or the second mount 38. To facilitate movement of the seat 14 between the first mount 36 and the second mount 38, the floor support 50 includes wheels beneath it. When the coupling flange 70 is arranged at a desired position at either the first mount 36 or the second mount 38 with the aperture 40 of the first or second mount 36/38 aligned with the aperture of the coupling flange 70, a pin 72 can be inserted through the apertures to lock the seat 14 in the desired position.

Figure 2:
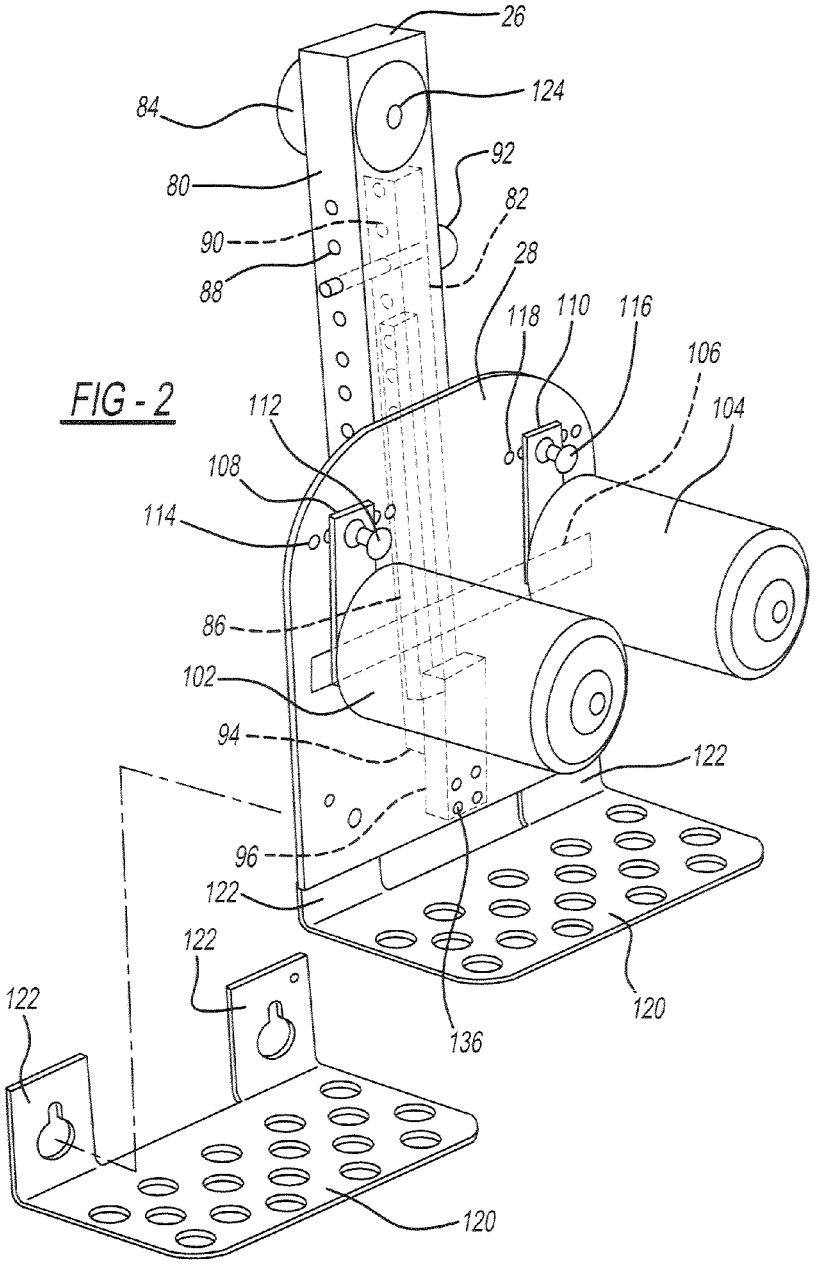
FIG. 2 is a perspective view of an actuation member of the exercise device of FIG. 1.

FIG. 2 illustrates additional details of the actuation arm 26. The actuation arm 26 includes an outer arm 80 and an inner arm 82. The outer arm 80 is coupled to the horizontal shaft 84, which protrudes out from within the case 12. The inner arm 82 is slidably coupled to a track 86, which is mounted within the outer arm 80. The outer arm 80 defines a series of outer apertures 88, and the inner arm 82 defines a series of inner apertures 90, which are aligned with the outer apertures 88. The inner arm 82 can telescope outward and inward from within the outer arm 80 along the track 86. When the inner arm 82 is at a desirable position, which typically depends on the length of the user's limb being exercised, the inner arm 82 can be locked in position with a pin 92 inserted through the outer apertures 88 and the inner apertures 90.

Mounted to a distal end of the inner arm 82 is a load cell 96, which will be described in further detail herein. The limb coupling member 28 is coupled to the load cell 96 to mount the limb coupling member 28 to the actuation arm 26 via the load cell 96. The limb coupling member 28 includes a first support pad 102 and a second support pad 104. Each of the first and the second support pads 102 and 104 are mounted to, and can be slidably positioned along, a support rail 106. Extending from the first support pad 102 is a first flange 108, and extending from the second support pad 104 is a second flange 110. The first flange 108 includes a first pin 112, which can be selectively inserted in any one of first apertures 114 defined in the limb coupling member 28 to lock the first support pad 102 at a desired position along the support rail 106. The second flange 110 includes a second pin 116, which can be selectively inserted in any one of second apertures 118 defined in the limb coupling member 28 to lock the second support pad 104 at a desired position along the support rail 106. The first support pad 102 and the second support pad 104 are often positioned depending on the size of the user's ankle to closely abut and secure the ankle therebetween.

An end plate 120 can be coupled to the limb coupling member 28 to serve as a foot support. The end plate 120 includes a pair of spaced apart end plate flanges 122, which are configured to couple with bosses 126 extending from a rear side of the limb coupling member 28. The end plate 120 can be removably mounted to the limb coupling member 28 and the exercise device 10 can fully function with or without the end plate 120.

Figure 3:
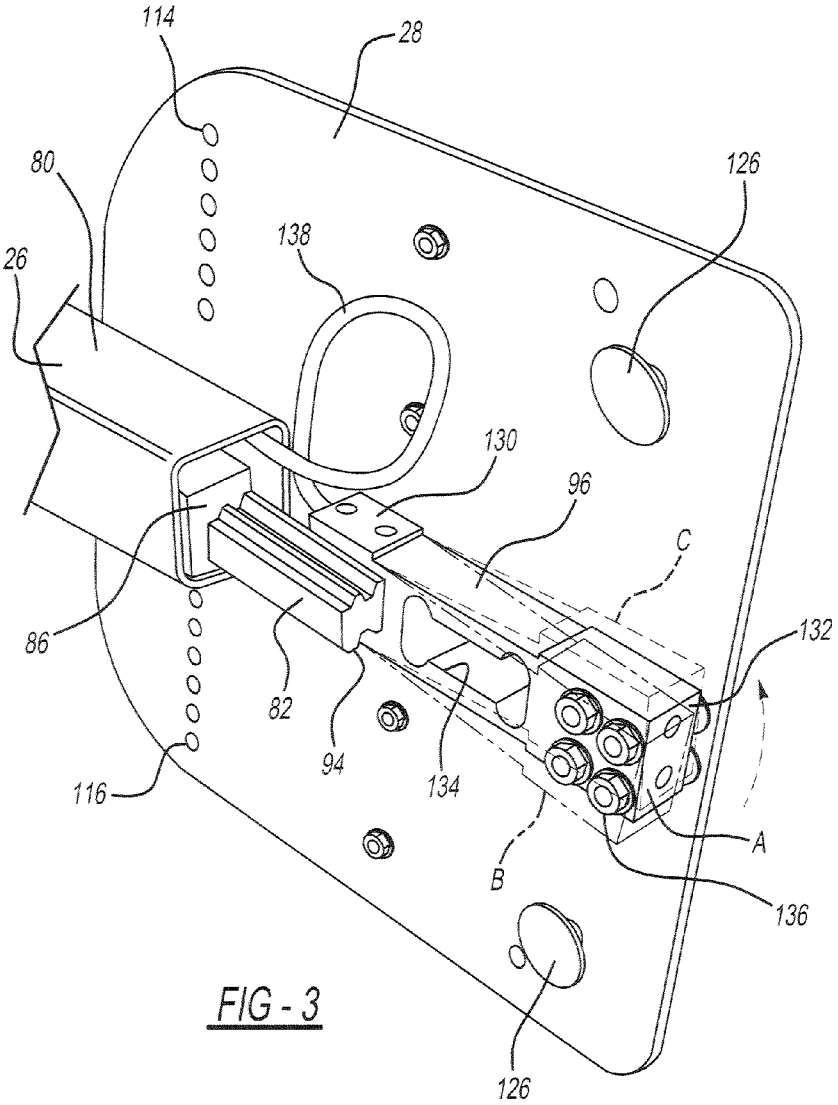
FIG. 3 is a perspective view of a load cell coupled to the actuation member.

With continued reference to FIG. 2 and additional reference to FIG. 3, the load cell 96 includes a proximal end 130 and a distal end 132. Between the proximal end 130 and the distal end 132, the load cell 96 defines an aperture 134. The proximal end 130 of the load cell 96 is coupled to the distal end 94 of the inner arm 82 in any suitable manner, such as with a series of fasteners to rigidly couple the proximal end 130 to the inner arm 82. The distal end 132 of the load cell 96 is rigidly coupled to the limb coupling member 28 with a series of fasteners or screws 136. The load cell 96 can be any suitable load cell, such as model AZL (serial no. NW020231) from Laumas Elettronica of Italy. The load cell 96 can be configured for any suitable load, such as 50 kg (about 110 lbs.). The load cell 96 can be provided with any suitable sensitivity, such as about 1.945 mV/V.

In response to force (or pressure) between the user's limb and the limb coupling member 28, such as at either of the first support pad 102 or the second support pad 104, the load cell 96 will bend. For example, and as illustrated in FIG. 3, the distal end 132 of the load cell 96 can bend relative to the proximal end 130 from first position A to second position B in response to force applied to the second support pad 104 by the user when the user flexes his or her leg, or in response to pressure exerted against the user's leg by the actuation arm 26 at the second support pad 104 when the actuation arm 26 is extending the leg. The distal end 132 may also bend in the opposite direction to a third position C, such as when the user applies force to the first support pad 102 when the user extends his/her leg, or when the actuation arm 26 applies force to the user's leg at the first support pad 102 to flex the leg. The distance that the load cell 96 bends is proportional to the amount of force or pressure between the limb coupling member 28 and the limb. The load cell 96 produces an electrical output via connector 138 representative of the distance that the load cell 96 bends, and the amount of force or pressure between the limb coupling member 28 and the limb.

Figure 4:
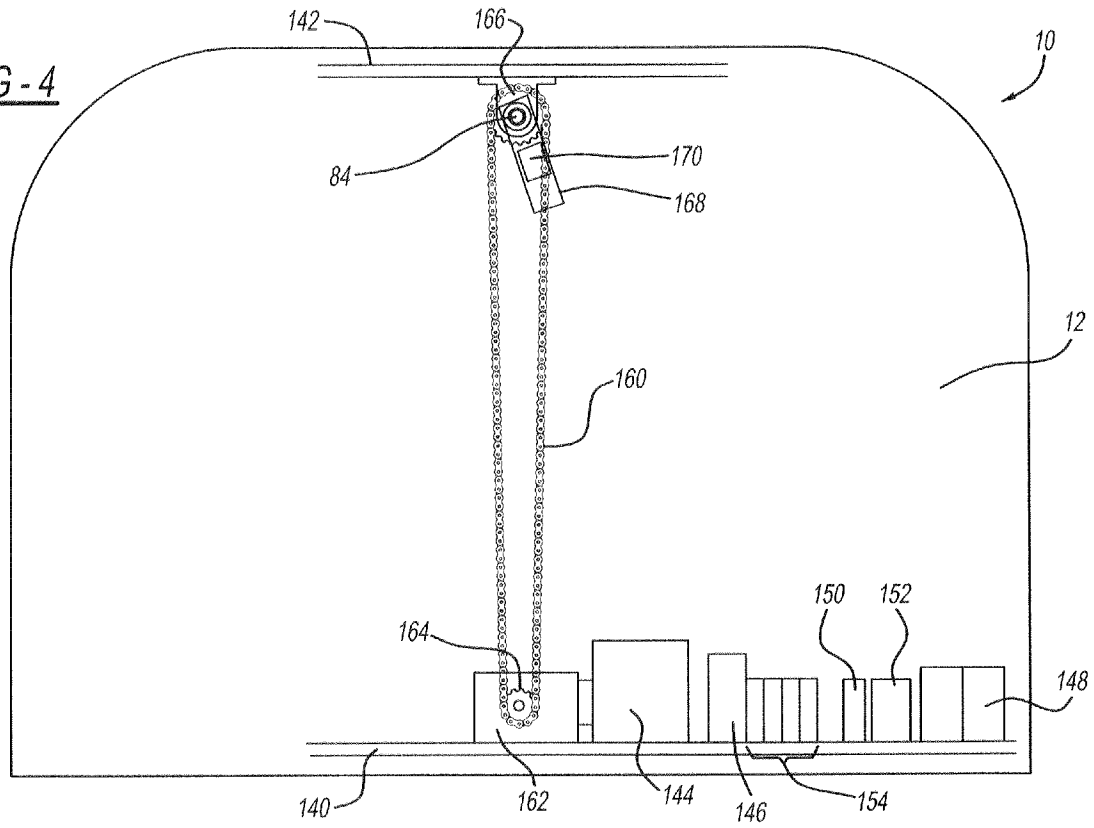
FIG. 4 is a side view of interior components of the exercise device of FIG. 1.

With additional reference to FIG. 4, internal components of the case 12 will now be described. The case generally includes a base 140 and an upper support 142. Mounted at the base 140 is a motor 144, a power supply 146, a controller 148, an inclinometer transmitter 150, a load cell sensor 152, and a plurality of relays 154. The motor 144 can be any suitable motor for moving the actuation arm 26 and for providing resistance to movement of the actuation arm 26 as described herein. For example, the motor can be an Elektrimax 56C 1800 RPM 3-phase rolled steel foot mounted motor. The motor 144 is powered by the power supply 146, which can be any suitable power supply sufficient to power the motor 144. For example, the power supply can be no. E225775 by Reign Power Co. Ltd. of Taipei, Taiwan. Controller 148 can be any suitable controller for controlling operation of the exercise device 10, such as the FlexiLogics FL 010 and FL A0800A by Renu Electronics PVT, Ltd. of India. The load cell sensor 152 can be any suitable sensor for receiving inputs from the load cell 96, such as Model 4710 Bridgesensor by Calex of Concord, Calif.

A suitable connection member, such as a belt or chain 160, extends from about the base 140 of the case 12 to about the upper support 142. The chain 160 can be directly connected to an output shaft of the motor 144, or can be connected to an output shaft of gear box 162 at a first gear 164. From the first gear 164 the chain 160 extends to a second gear 166 at the upper support 142. The second gear 166 is mounted to the horizontal shaft 84, which is mounted to the upper support 142. Therefore, the motor 144 drives the chain 160, which in turn rotates the horizontal shaft 84 to rotate the actuation arm 26 mounted to the horizontal shaft 84. The motor 144 can also be configured to resist movement of the actuation arm 26 unless the user applies a preset force to the actuation arm 26. An inclinometer shaft 168 with an inclinometer 170 attached thereto is mounted to the horizontal shaft 84 and rotates with the horizontal shaft 84. Because the actuation arm 26 is mounted to the horizontal shaft 84, the incline and degree of rotation of the inclinometer will correspond to the position of the actuation arm 26. The inclinometer 170 is connected to the inclinometer transmitter 150 to convey the position of the inclinometer 170, and thus the position of the actuation arm 26 as well, to the controller 148. Any suitable inclinometer 170 can be used, such as Model 981HE by Vishay Technology, Inc. of Malvern, Pa.

As illustrated in FIG. 1, the actuation arm 26 is configured to rotate between a maximum extended position 180 and a maximum flexed position 182 along an arc X (which includes X' and X" as illustrated). At the maximum extended position 180, the actuation arm 26 will fully extend the user's leg, such that both the user's leg and the actuation arm 26 extend about parallel to the surface that the case 12 and the seat 14 are seated on. Thus, in the maximum extended position the user's leg is at about a 0° angle. In the maximum flexed position 182, the user's leg will be flexed inward. The arc X includes an extension arc portion X' and a flexion arc portion X". The extension portion X' extends from a neutral position 184, at which the actuation arm 26 is about perpendicular to the surface that the case 12 is seated on (as illustrated in FIG. 1), to the maximum extended position 180. In the neutral position the user's leg is bent at about a 90° angle. The flexion portion X" extends from the neutral position 184 to the maximum flexed position 182, which can be about an additional 35° from neutral position 184, which would position the user's leg at about a 135° angle. The range of motion arc X is provided for exemplary purposes only, and thus the actuation arm 26 can be configured to rotate along any suitable range. The case 12 can include hard stops for the actuation arm 26, such as a bar protruding from the case 12, to prevent the actuation arm 26 from rotating beyond each of the maximum extended position 180 and the maximum flexed position 182.

Figure 5:
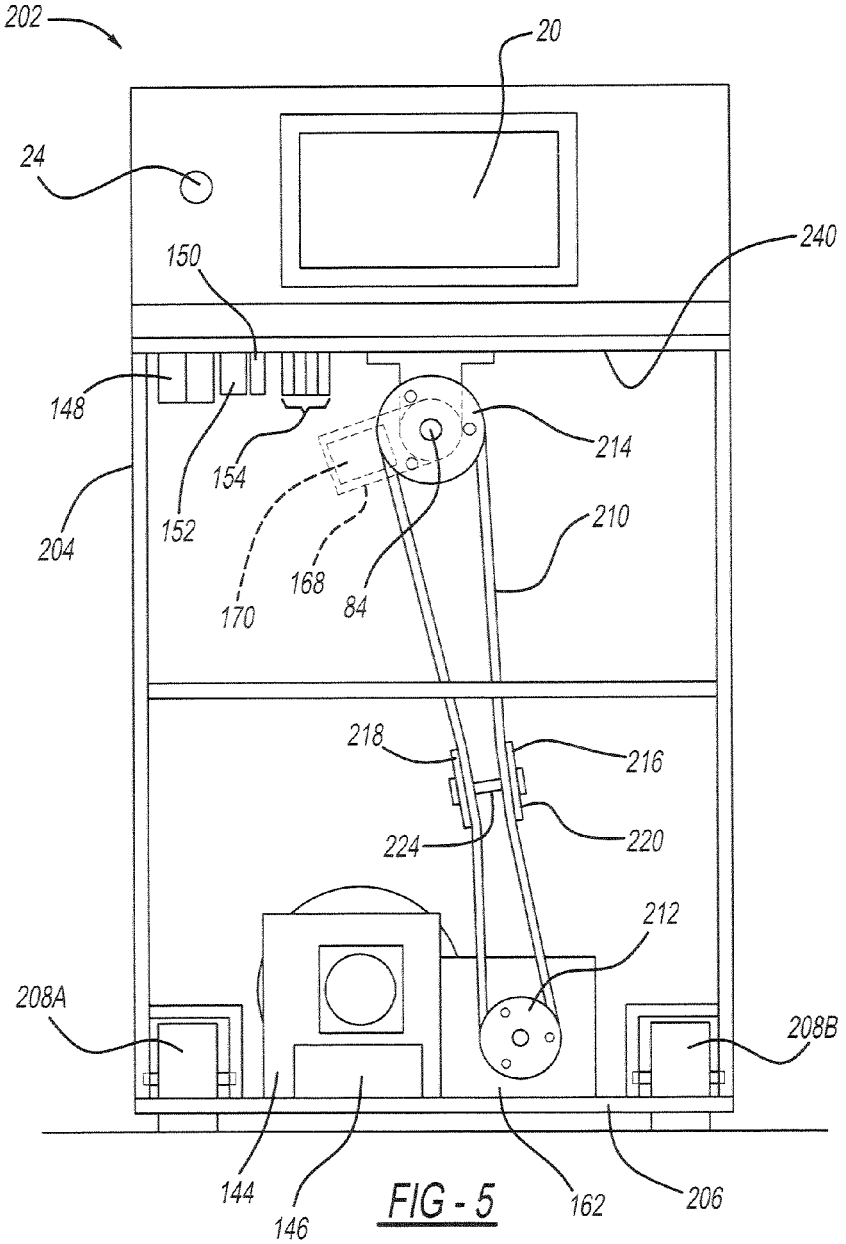
FIG. 5 is a side view of another exercise device according to the present teachings.

With additional reference to FIG. 5, another exercise device according to the present teachings is illustrated at reference numeral 202. The exercise device 202 includes a case 204, which is generally smaller than the case 12 of the exercise device 10. The case 204 includes a base 206 with wheels 208A and 208B mounted thereto. The exercise device 202 is thus a portable device that can be, for example, delivered to a user's home for home use. The internal components of the device 202 are similar to the internal components of the device 10, and thus the same reference numbers are used to designate the similar components, and the description of the similar components in connection with the description of the exercise device 10 also describes the exercise device 202. The exercise device 202 is illustrated as including a belt 210, but may alternatively include the chain 160 of the device 10, or any other suitable torque transfer member. The belt 210 is illustrated at being coupled to a first wheel 212 at the gear box 162, but can be connected directly to the motor 144. The belt 210 is also coupled to second wheel 214, which is coupled to the horizontal shaft 84 to thereby transfer torque from the motor 144 to the horizontal shaft 84 and the actuation arm 26, which is coupled to the horizontal shaft of the exercise device 202. Various interior components of the exercise device 202 that were seated at the base 140 of the case 12 have been moved to an upper support 240 of the exercise device 202, such as the controller 148, the load cell sensor 152, the inclinometer transmitter 150, and the relays 154.

Mounted to the belt 210 is a clamp 216. The clamp 216 includes a first plate 218 and a second plate 220, each of which abut opposing portions of the belt 210. The first plate 218 is connected to the second plate 220 with a spring 224. At least one of the first plate 218 and the second plate 220 can be in the form of a roller. The spring 224 biases the second plate 220 against the first plate 218. Therefore, when the motor 144 stops and the belt 210 stops rotating, the clamp 216 will pull the portion of the belt 210 abutting the second plate 220 toward the first plate, which will cause the actuation arm 26 to rotate away from the base of the case 204 toward the maximum extended position 180. The clamp 216 can be included with the exercise device 10, particularly when the exercise device 10 includes the belt 210.

Figure 6:
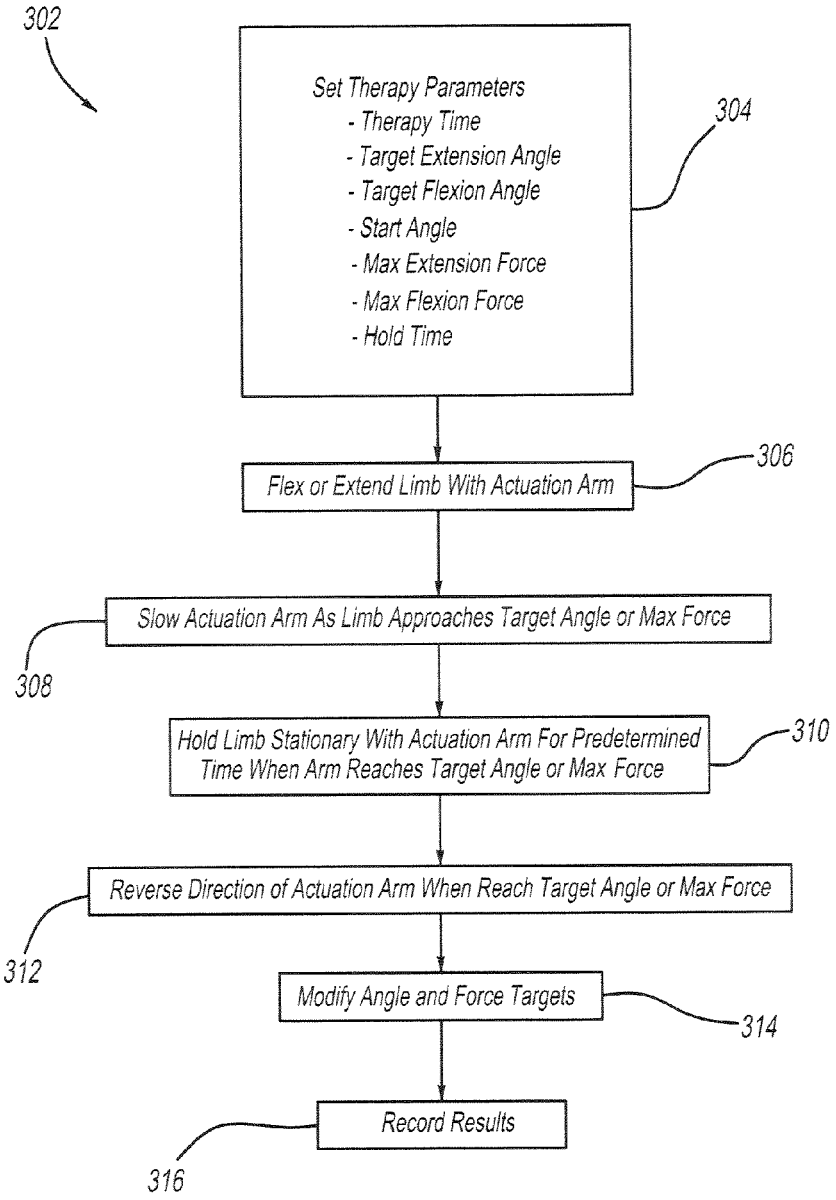
FIG. 6 is a flow chart of a control method according to the present teachings for an exercise device.

With reference to FIG. 6, a method, such as a therapy method, of operation of the exercise device 10, the exercise device 202, or any other suitable exercise or therapy device is generally illustrated at reference number 302. The method 302 is generally a passive mode in which the user does not positively exert force or pressure against the actuation arm 26, and thus does not contract his/her leg muscles. Rather, it is the actuation arm 26 that moves the user's leg. The greater the force or pressure exerted by the actuation arm 26 against the leg, the further the leg will extend or flex.

At block 304, therapy parameters are set to customize the method 302. A variety of different parameters can be set, such as one or more the following: therapy time, target extension angle, target flexion angle, start angle, maximum extension force, maximum flexion force, and hold time. The parameters can be input using the display 20, which can be a touch screen. While the maximum extension and flexion forces are generally described herein in terms of "force," they can also be described in terms of "pressure."

The therapy time is typically the total time that the patient's limb is exercised, such as about 30 minutes. The target extension angle is the angle to which the limb is to be extended along the arc X' away from the neutral position 184 and in the direction of the maximum extended position 180. For example, if the target is to straighten the leg and move the leg to the maximum extended position 180, then the target angle will be 0°. If the target is to extend the leg to about halfway between the neutral position 184, in which the leg is bent at about 90°, and the maximum extended position 180, then the target extension angle will be about 45°. The target flexion angle is the angle to which the limb is to be flexed along the arc X" from the neutral position 184 to the maximum flexed position 182. For example, if the target is to fully flex the leg, then the target flexion angle will be set to about 125° or more. The target extension and flexion angles can be determined by assessing the range of motion of the user's leg. The start angle is the angle along the arc X (which is illustrated as including arcs X' and X") that the leg and the actuation arm 26 are desired to be started at. For example, if the actuation arm 26 is to start from the neutral position 184, the start angle will be about 90°.

The maximum extension force is the maximum force or pressure to be applied to the user's leg by the actuation arm 26 as the user's leg is extended along the extension arc X' in the direction of the maximum extended position 180. The maximum flexion force is the maximum force or pressure to be applied to the user's leg by the actuation arm 26 as the user's leg is flexed along the flexion arc X" in the direction of the maximum flexed position 182. The maximum extension and the maximum flexion forces can be determined by assessing the condition of the user's leg, and particularly the amount of force that the leg is able to withstand without the user incurring excessive pain. The hold time is the amount of time that the actuation arm 26 is to optionally hold the leg at the target extension angle, the target flexion angle, the point where the maximum extension force is reached, or the point where the maximum flexion force is reached.

After the therapy parameters are set at block 304, the actuation arm 26 will rotate from the set start angle in either the extension direction (towards the maximum extended position 180) or the flexion direction (toward the maximum flexed position 182) to extend or flex the leg at block 306. If initially moved in the extension direction for example, the actuation arm 26 will slowly rotate and then slow further to a creep when either the target extension angle or the maximum extension force is about to be reached, as set forth at block 308. By slowing to a creep, excess fluid, such as scar tissue forming fibroblast fluid, is given the opportunity to exit the knee joint. Once the target extension angle or the maximum extension force is reached, the actuation arm 26 will hold the leg in position at block 310, which can further allow excess fluid drain from the knee joint, thereby making the buildup of scar tissue less likely. After the hold time has expired, the actuation arm 26 will rotate in the opposite direction at block 312, such as in the flexion direction (toward the maximum flexed position 182), until the target flexion angle or the target flexion force is reached. As the actuation arm 26 approaches the target flexion angle or the maximum force, the actuation arm 26 will again slow to a creep and then will hold the leg at the preset hold time, to again permit excess fluid to exit the knee joint.

With reference to block 314, during operation of the method 302 the target extension and flexion angles, as well as the maximum extension and flexion forces, can be modified, such as according to the user's progress. For example, as the leg is extended and flexed, excess fluid will drain from the knee and scar tissue will breakdown thereby increasing the range of motion of the leg and increasing the amount of force or pressure that the user is able to withstand. Therefore, the target angles and maximum force can be increased.

The maximum extension and maximum flexion force is measured with the load cell 96. For example, as the actuation arm 26 moves to the maximum extended position 180, the second support pad 104, which pushes the leg upward, applies force, such as pressure, to the user's ankle, which is between the first support pad 102 and the second support pad 104. The force is generally applied at a single point in a single direction upward toward the maximum extended position 180. As the actuation arm 26 moves toward the maximum extended position 180, more and more force must be applied to flex the leg, particularly when the range of motion of the leg is limited. If the leg's resistance to extension is great enough, the load cell 96 will bend from position A to position B of FIG. 3. The load cell 96 will transmit the degree of bend to the load cell sensor 152 via the connector 138, and ultimately the controller 148. The degree of bend is proportionate to the amount of force or pressure applied by the actuation arm 26. Therefore, by monitoring the degree of bend of the load cell 96, the controller 148 can determine the amount of force or pressure applied by the actuation arm 26 and identify when the maximum extension force is reached. The flexion pressure is monitored in a similar manner. As the actuation arm 26 moves from the neutral position 184, the first support pad 102 will apply force or pressure to the ankle, thereby causing the load cell 96 to bend in the opposite direction to position C. At block 316 the results of the method 302 can be recorded.

Figure 7:
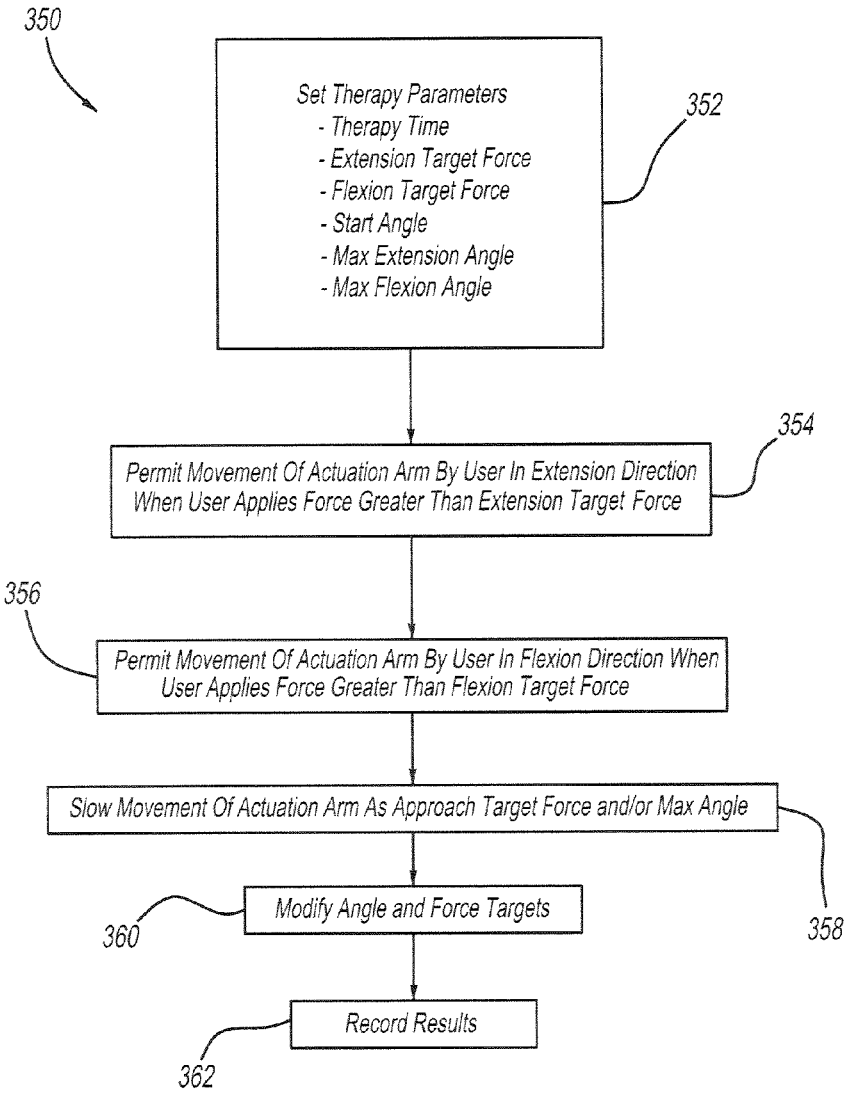
FIG. 7 is a flow chart of another control method according to the present teachings for an exercise device.

With reference to FIG. 7, another method of operating an exercise device, such as the exercise device 10 or the exercise device 202 for example, is illustrated at reference numeral 350. The method 350 is an active isotonic mode whereby the user contracts muscles of the leg through the entire range of motion to move the actuation arm 26, which provides resistance and will not be permitted to move by the motor unless the user exerts sufficient force against the actuation arm 26 to reach the extension target force or the flexion target force. For example, as the user moves the actuation arm towards the maximum extended position 180, the quadriceps are exercised. As the user moves the actuation arm toward the maximum flexed position 182, the hamstrings are exercised. The actuation arm 26 thus provides resistance to the user's leg both when the leg is being extended and flexed.

With initial reference to block 352, the parameters of the active isotonic therapy are set. The therapy time is the total time of the method 350. The extension target force is the force that the user must exert against the actuation arm 26 to cause the actuation arm 26 to move toward the maximum extended position 180. The flexion target force is the force sure that the user must exert against the actuation arm 26 to cause the actuation arm 26 to move toward the maximum flexed position 182. The start angle is the position along the rotation arc X that the actuation arm 26 is to start at. The maximum extension angle is the maximum distance that the actuation arm 26 is to extend along the extension arc X' from the neutral position 184. The maximum flexion angle is the maximum distance that the actuation arm 26 is to flex along the flexion arc X" towards the maximum flexed position 182. The maximum extension and flexion angles are determined by the maximum distance that the user's leg can be extended or flexed without the user experiencing undue pain.

With reference to block 354, once the user applies enough force against the stationary actuation arm 26, particularly against the first support pad 102, to reach the extension target force as measured by the degree of bend of the load cell 96, the actuation arm 26 will move toward the maximum extended position 180. As long as the user continues to exert force at or above the extension target force, the actuation arm 26 will continue to move toward the maximum extended position 180. As the actuation arm 26 nears the maximum extension angle, which may be at the maximum extended position 180 or at any other position along the extension arc X', the actuation arm may be configured to progressively apply resistance force to the user's leg to slow movement of the actuation arm 26 to a creep, which facilitates drainage of fluid from the knee and breaks down scar tissue. The user's quads will be exercised as the actuation arm 26 is moved along the flexion arc X' in the direction of the maximum extended position 180.

With reference to block 356, the user exercises his/her hamstrings by flexing his/her leg and moving the actuation arm 26 toward the maximum flexed position 182. The actuation arm 26 will continue to move toward the maximum flexed position 182 to the maximum flexion angle as long as the force exerted by the user is greater than the flexion target force as measured by the load cell 96. At block 358, the actuation arm 26 will slow further, such as to a creep, as the target pressure and or maximum angle is approached. As set forth at block 360, the extension and flexion target force and angles can be modified during the therapy method 350. For example, the target force and angles can be increased as the user's range of motion increases. The results of the therapy can be recorded at block 362.

Figure 8:
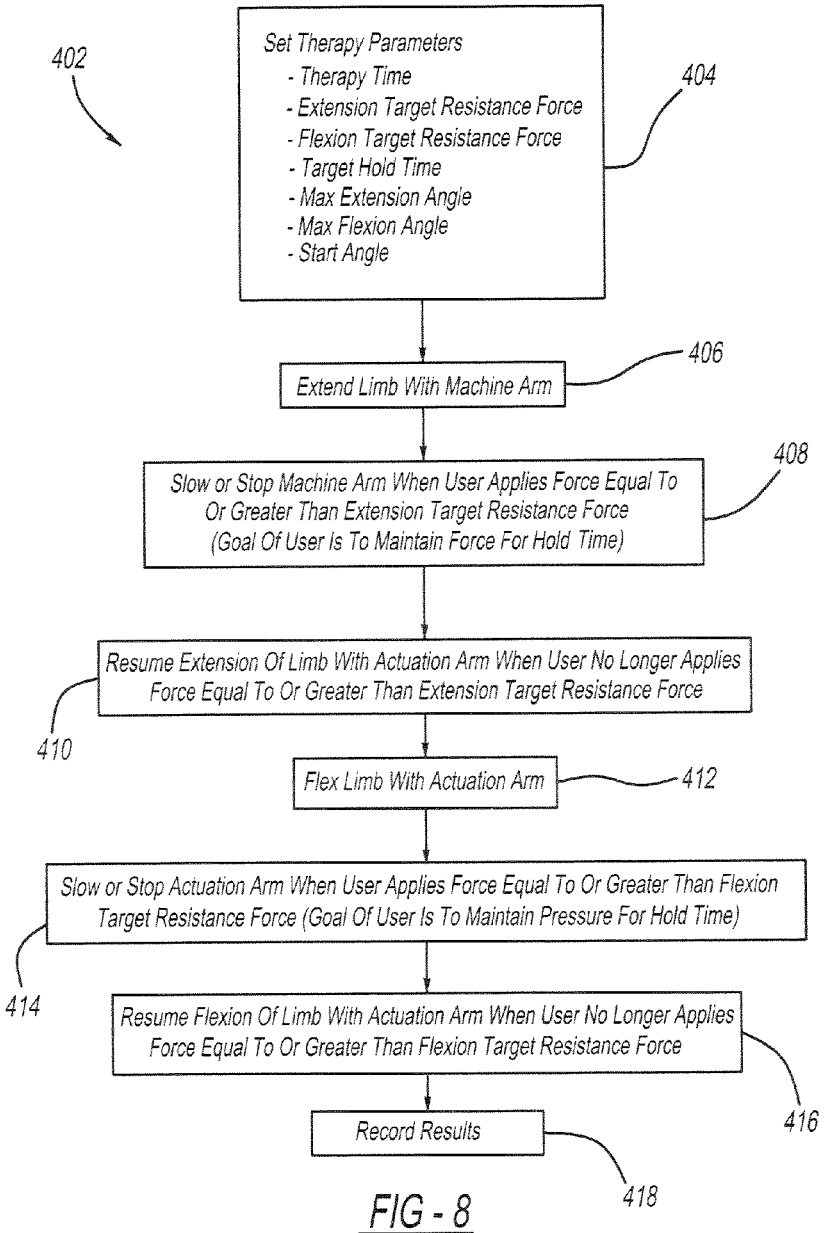
FIG. 8 is a flow chart of yet an additional control method according to the present teachings for an exercise device.

With reference to FIG. 8, an additional method of operating an exercise device, such as the exercise device 10 or the exercise device 202, is illustrated at reference numeral 402. The method 402 is an active eccentric method in which the actuation arm 26 moves until the user applies enough force or pressure to stop the actuation arm 26 or slow the actuation arm 26 to a creep. To stop or slow the actuation arm 26, the user must apply force in a direction opposite to the direction of movement of the actuation arm 26.

With initial reference to block 404, therapy parameters of the method 402 are set. For example, the following exemplary parameters are set: therapy time, extension target resistance force, flexion target resistance force, target hold time, maximum extension angle, maximum flexion angle, and start angle. The therapy time is the total time of the method 402, such as about 30 minutes. The extension target resistance force is the force that the user must exert on the actuation arm 26 to stop or slow the actuation arm 26 as the actuation arm 26 moves toward the maximum extended position 180 to extend the leg. The flexion target resistance force is the force that the user must exert on the actuation arm 26 to stop or slow the actuation arm 26 as the actuation arm 26 moves toward the maximum flexed position 182. The target resistance force are measured by the load cell 96. The target hold time is the target period of time that the user is to apply the resistance forces. The maximum extension angle is the maximum distance that the actuation arm 26 travels along the extension arc X' toward the maximum extended position 180. The maximum flexion angle is the maximum distance that the actuation arm 26 travels along the flexion arc X" toward the maximum flexion position 182. The maximum extension and flexion angles are determined by the maximum range of motion that the user is able to endure without experiencing undue pain and/or stress.

At block 406, the user's limb is extended with the actuation arm 26. Although extension of the limb will be described first, flexion of the limb with the actuation arm 26 at block 412 may be performed first. With reference to block 408, the actuation arm 26 will slow or stop when the user applies force equal to or greater than the extension target resistance force. The goal of the user is to maintain the extension target resistance force for the target hold time, which can be displayed on the display 20, such as in the form of a countdown timer. At block 410, the actuation arm 26 will resume its initial speed when the force applied by the user is below the extension target resistance force, and proceed to the maximum extension angle. As the actuation arm 26 proceeds to the maximum extension angle, the user will attempt to again apply the extension target resistance force at regular intervals. As the actuation arm 26 nears the maximum extension angle, it will slow to a creep and then stop when it reaches the maximum extension angle.

After reaching the maximum extension angle the actuation arm 26 will reverse to flex the user's limb, as set forth at block 412. The actuation arm 26 will slow or stop when the user applies force equal to or greater than the flexion target resistance force, as set forth at block 414. The user will attempt to hold the flexion target resistance force for the target hold time. At block 416, the actuation arm 26 will resume its initial speed when the force applied by the user is below the flexion target resistance force, and proceed to the maximum flexion angle. As the actuation arm 26 proceeds to the maximum flexion angle, the user will attempt to again apply the flexion target resistance force at regular intervals. As the actuation arm 26 nears the maximum flexion angle, it will slow to a creep and then stop when it reaches the maximum flexion angle. At block 418, the results of the method 402 are recorded.

The results recorded at blocks 316, 362, and 418 can be used to track the user's progress, and to customize future therapy or exercise to best suit the user. The results can also be conveyed to a therapist, doctor, or other healthcare provider, such as via the Internet, so that the healthcare provider can monitor the patient's progress remotely.

Each of the exercise devices 10 and 202 can be configured to provide any one or more of the methods 302, 350, and 402. For example the portable exercise device 202 could only include the passive method set forth at 302, such as to reduce costs.

The exercise devices 10 and 202, as well as the methods 302, 350, and 402 can be modified in any suitable manner to exercise and/or rehabilitate any joint or limb, including but not limited to an elbow, a shoulder, a hip, an ankle, a neck, fingers, toes, arms, etc.

The exercise devices 10 and 202, and the methods 302, 350, and 402 can be included not only in a physical therapy device to rehabilitate a total knee replacement, for example, but can also be included in an exercise machine found in a gym or workout area to be used to increase strength and stamina. For example, the methods 302, 250, and 402 can be implemented in any exercise machine with an actuation arm, such as by outfitting the exercise machine with the load cell 96 on the actuation arm and including with the machine the motor 144, inclinometer 170, controller 148, power supply 146, and other components of the exercise devices 10 and 202.

Figure 9A:
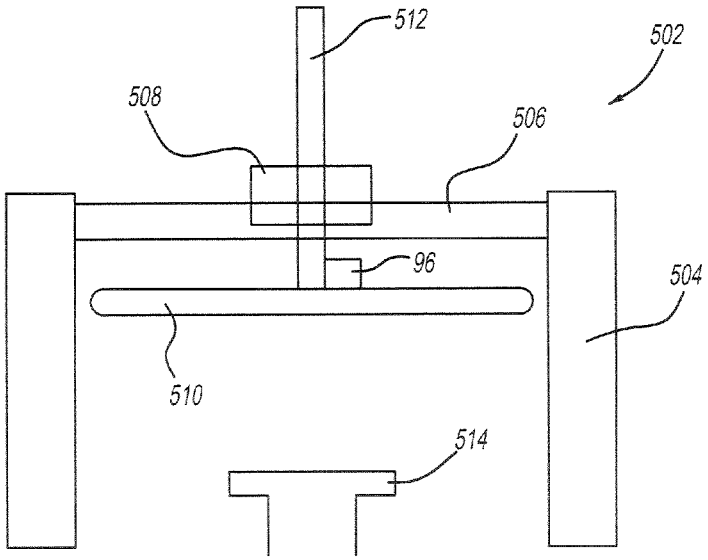
FIG. 9A illustrates an additional exercise device according to the present teachings in a first position.
Figure 9B:
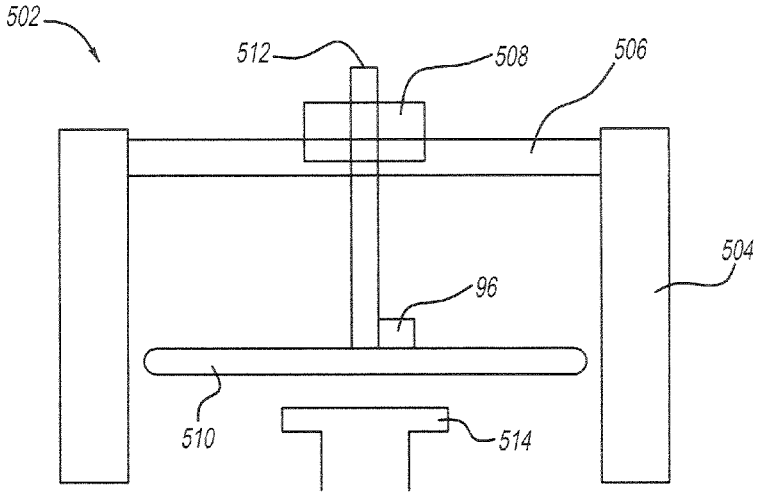
FIG. 9B illustrates the exercise device of FIG. 9A in a second position.

An exemplary exercise device is illustrated in FIGS. 9A and 9B in the form of a bench press at reference numeral 502. The bench press 502 generally includes vertical supports 504 and a crossbar 506 extending therebetween. Mounted to the crossbar 506 is a control module 508. The control module 508 includes the motor 144, the power supply 146, the controller 148, the inclinometer 170, and the load cell sensor 152 for receiving inputs from the load cell 96. Each of these components is generally similar to those described above with the same reference numbers. While the control module 508 is illustrated as mounted to the crossbar 506, one or more components of the control module 508 can be positioned elsewhere, such as on a floor proximate to the bench press 502.

The motor 144 is configured to resist movement of actuation member 510 between the first position of FIG. 9A and the second position of FIG. 9B, as well as resist movement between the second position and the first position, such as according to the method 350 of FIG. 7. The actuation member 510 is illustrated as a bar with a vertical portion 512 extending therefrom. The vertical portion 512 is in cooperation with the control module 508 and the motor 144.

The load cell 96 is positioned at any suitable location to be able to sense the force applied to the actuation member 510 by a user seated on or lying on seat 514, such as on the actuation member 510 itself. For the user to move the actuation member 510 from the first position of FIG. 9A to the second position of FIG. 9B, the user must pull on the actuation member 510 and apply sufficient force as measured by the load cell 96 to overcome a first target force entered into the control module 508, such as via the display 20 mounted at or near the bench press 502. When the actuation member 510 is pulled proximate to a first target distance, the resistance provided by the motor 144 can be increased to slow movement of the actuation member 510, such as to a creep, which will enhance working of the user's muscles. When the actuation member 510 reaches the first target distance, the motor 144 will prevent the actuation member 510 from moving further. The user can then return the actuation member 510 to the first position of FIG. 9A by pushing upward and applying enough force, as measured by the load cell 96, to reach or overcome a second target force. The motor 144 will allow the actuation member 510 to be moved upward to the first position of FIG. 9A as long as the user applies force equal to or greater than the second target force. As the actuation member 510 nears the second target distance of FIG. 9A, the resistance provided by the motor 144 can increase to slow movement of the actuation member 510, such as to a creep, which will enhance working of the muscles. Although the actuation member 510 is illustrated as an actuation bar for a bench press, the actuation member 510 can be any suitable actuation member for working any suitable body part, such as an actuation plate for a leg press.

The exercise devices 10 and 202, as well as the methods 302, 350, and 402 differ in a number of ways from prior rehabilitation and strength building techniques, such as continuous passive motion machines. With respect to the passive mode 302 for example, by fixing the force applied by the actuation arm 26 below the patient's pain tolerance, excessive pain and further strain on the joint can be avoided while allowing the body to naturally increase range of motion, such as by breaking down scar tissue and allowing excess fluid to drain from the knee. The maximum flexion and extension force can be increased during the therapy, and the maximum extension and flexion angles can be set outside of the user's natural range of motion to enable a natural, progressive increase in the patient's effective range of motion without exceeding the patient's pain threshold, which can result in greater lasting range of motion improvements.

Because continuous passive motion machine therapy is limited in its ability to increase range of motion, total knee replacement rehabilitation is often performed using manual manipulation—one-on-one with a licensed physical therapist. The exercise device 10 and 202 described herein, as well as the methods 302, 350, and 402, provide more precision and control than manual manipulation, and require less direct intervention on behalf of a therapist, which provides an efficient and effective way to rehabilitate patients in an inpatient and outpatient setting while enabling significant labor productivity gains.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An exercise device for exercising a joint and a limb comprising:

a controller;

an actuation member controlled by the controller and configured to move between a first position and a second position;

a limb coupling member configured to connect the limb to the exercise device;

a load cell mounted to the actuation member, the load cell configured to measure force between the limb and the actuation member; and a motor configured to control movement of the actuation member in response to inputs from the controller;

wherein the limb coupling member is coupled to the load cell to mount the limb coupling member to the actuation member by way of the load cell.

2. The exercise device of claim 1, wherein the actuation member slows or stops extension of the limb when a measured extension force between the actuation member and the limb is at least equal to a predetermined target extension force; and wherein the actuation member slows or stops flexion of the limb when a measured flexion force between the actuation member and the limb is at least equal to a predetermined target flexion force.

3. The exercise device of claim 1, wherein the motor prevents movement of the actuation member in an extension direction unless extension force exerted by the limb against the actuation member is equal to or greater than a predetermined target extension force; and wherein the motor prevents movement of the actuation member in a flexion direction unless flexion force exerted by the limb against the actuation member is equal to or greater than a predetermined target flexion force.

4. The exercise device of claim 1, wherein the actuation member is configured to rotate in a plane perpendicular to a floor surface that the exercise device is seated on.

5. The exercise device of claim 1, further comprising:

a housing including the motor;

a seat mounted to the housing; and a touchscreen interface mounted to an exterior of the housing;

wherein the actuation member is mounted at an exterior of the housing.

6. The exercise device of claim 5, wherein the housing includes wheels for moving the exercise device.

7. The exercise device of claim 5, wherein the housing includes a track extending along a length of the housing, the seat is configured to be mounted to a first end of the track to permit cooperation between a first limb and the actuation member, and the seat is configured to be mounted to a second end of the track to permit cooperation between a second limb and the actuation member.

8. The exercise device of claim 5, wherein the seat includes a knee support to support the knee opposite to an axis of rotation of the actuation member.

9. The exercise device of claim 1, further comprising an inclinometer that rotates with the actuation member to determine the actuation member's position.

10. An exercise device for exercising a joint and a limb comprising:

a controller;

an actuation member controlled by the controller and configured to move between a first position and a second position;

a limb coupling member configured to connect the limb to the exercise device;

a load cell defining an aperture between a first end of the load cell and a second end of the load cell opposite to the first end, the first end is rigidly coupled to the actuation member and the second end is rigidly coupled to the limb coupling member to mount the limb coupling member to the actuation member solely by way of the load cell, the load cell configured to bend between the first end and the second end to measure force between the limb and the actuation member; and a motor configured to control movement of the actuation member in response to inputs from the controller;

wherein:

in an unstressed position of the load cell the load cell extends along a longitudinal axis extending between the first end and the second end, the longitudinal axis extending parallel to the actuation member; and in a stressed position of the load cell, in which the load cell is bent between the first end and the second end to measure force between the limb and the actuation member, the second end is offset relative to the longitudinal axis.

11. The exercise device of claim 10, wherein the actuation member slows or stops extension of the limb when a measured extension force between the actuation member and the limb is at least equal to a predetermined target extension force; and wherein the actuation member slows or stops flexion of the limb when a measured flexion force between the actuation member and the limb is at least equal to a predetermined target flexion force.

12. The exercise device of claim 10, wherein the motor prevents movement of the actuation member in an extension direction unless extension force exerted by the limb against the actuation member is equal to or greater than a predetermined target extension force; and wherein the motor prevents movement of the actuation member in a flexion direction unless flexion force exerted by the limb against the actuation member is equal to or greater than a predetermined target flexion force.

13. The exercise device of claim 10, further comprising:

a housing including the motor;

a seat mounted to the housing; and a touchscreen interface mounted to an exterior of the housing;

wherein the actuation member is mounted at an exterior of the housing.

14. The exercise device of claim 10, further comprising an inclinometer that rotates with the actuation member to determine the actuation member's position.

* * * * *